US010276909B2

(12) United States Patent
Huang et al.

(10) Patent No.: US 10,276,909 B2
(45) Date of Patent: Apr. 30, 2019

(54) STRUCTURE COMPRISING AT LEAST A FIRST ELEMENT BONDED TO A CARRIER HAVING A CLOSED METALLIC CHANNEL WAVEGUIDE FORMED THEREIN

(71) Applicant: INVENSAS BONDING TECHNOLOGIES, INC., San Jose, CA (US)

(72) Inventors: Shaowu Huang, Sunnyvale, CA (US); Javier A. DeLaCruz, San Jose, CA (US); Belgacem Haba, Saratoga, CA (US)

(73) Assignee: Invensas Bonding Technologies, Inc., San Jose, CA (US)

( * ) Notice: Subject to any disclaimer, the term of this patent is extended or adjusted under 35 U.S.C. 154(b) by 0 days.

(21) Appl. No.: 15/395,197

(22) Filed: Dec. 30, 2016

(65) Prior Publication Data

US 2018/0191047 A1 Jul. 5, 2018

(51) Int. Cl.

| | |
|---|---|
| ***H01P 3/12*** | (2006.01) |
| ***H01P 1/20*** | (2006.01) |
| ***H01P 5/107*** | (2006.01) |
| ***H01P 5/12*** | (2006.01) |
| ***H01P 1/39*** | (2006.01) |
| ***H01P 11/00*** | (2006.01) |
| ***H01P 3/16*** | (2006.01) |

(Continued)

(52) U.S. Cl.

CPC ..... *H01P 3/122* (2013.01); *H01P 1/2002* (2013.01); *H01P 1/39* (2013.01); *H01P 3/121* (2013.01); *H01P 3/16* (2013.01); *H01P 5/107* (2013.01); *H01P 5/12* (2013.01); *H01P 11/003* (2013.01); *H01P 11/006* (2013.01); *H01P 5/103* (2013.01); *H01P 5/181* (2013.01); *H01P 5/222* (2013.01); *H01P 5/227* (2013.01)

(58) Field of Classification Search

CPC ..... H01P 3/121; H01P 3/122; H01P 5/107
USPC ..... 333/248, 26
See application file for complete search history.

(56) References Cited

U.S. PATENT DOCUMENTS

| | | | |
|---|---|---|---|
| 4,998,665 | A | 3/1991 | Hayashi |
| 5,015,052 | A | 5/1991 | Ridgway et al. |

(Continued)

FOREIGN PATENT DOCUMENTS

| | | |
|---|---|---|
| EP | 1 441 410 B1 | 4/2006 |
| JP | 2000-100679 | 4/2000 |

(Continued)

OTHER PUBLICATIONS

U.S. Appl. No. 15/159,649, filed May 19, 2016, Uzoh et al.

(Continued)

*Primary Examiner* — Benny Lee
(74) *Attorney, Agent, or Firm* — Knobbe, Martens, Olson & Bear, LLP

(57) ABSTRACT

A structure can include a first element and a carrier bonded to the first element along an interface. A waveguide can be defined at least in part along the interface between the first element and the carrier. The waveguide can comprise an effectively closed metallic channel and a dielectric material within the effectively closed metallic channel, as viewed from a side cross-section of the structure. Various millimeter-wave or sub-terahertz components or circuit structures can also be created based on the waveguide structures disclosed herein.

23 Claims, 9 Drawing Sheets

(51) Int. Cl.

| | |
|---|---|
| *H01P 5/103* | (2006.01) |
| *H01P 5/18* | (2006.01) |
| *H01P 5/22* | (2006.01) |

(56) References Cited

U.S. PATENT DOCUMENTS 5,087,585 A 2/1992 Hayashi
5,225,797 A 7/1993 Schary et al.
5,322,593 A 6/1994 Hasegawa et al.
5,363,464 A 11/1994 Way et al.
5,408,053 A * 4/1995 Young ..... H01P 3/088 174/262
5,471,090 A 11/1995 Deutsch et al.
5,985,739 A 11/1999 Plettner et al.
5,998,808 A 12/1999 Matsushita
6,008,126 A 12/1999 Leedy
6,080,640 A 6/2000 Gardner et al.
6,265,775 B1 7/2001 Seyyedy
6,300,161 B1 10/2001 Goetz et al.
6,374,770 B1 4/2002 Lee
6,418,029 B1 7/2002 McKee et al.
6,442,321 B1 8/2002 Berini
6,614,960 B2 9/2003 Berini
6,638,808 B1 10/2003 Ochi
6,713,871 B2 3/2004 Searls et al.
6,782,179 B2 8/2004 Bozhevolnyi et al.
6,801,691 B2 10/2004 Berini
6,868,258 B2 3/2005 Hayata et al.
6,887,769 B2 5/2005 Kellar et al.
6,936,854 B2 8/2005 Iwasaki et al.
7,010,183 B2 3/2006 Estes et al.
7,078,811 B2 7/2006 Suga
7,126,212 B2 10/2006 Enquist et al.
7,339,798 B2 3/2008 Chakravorty
7,354,798 B2 4/2008 Pogge et al.
7,355,836 B2 4/2008 Radhakrishnan et al.
7,626,216 B2 12/2009 McKinzie, III
7,705,691 B2 4/2010 Lu et al.
7,741,724 B2 6/2010 Morikawa et al.
7,746,663 B2 6/2010 Hashimoto
8,183,127 B2 5/2012 Patti et al.
8,241,961 B2 8/2012 Kim et al.
8,314,007 B2 11/2012 Vaufredaz
8,357,931 B2 1/2013 Schieck et al.
8,476,146 B2 7/2013 Chen et al.
8,698,323 B2 4/2014 Mohammed et al.
8,841,002 B2 9/2014 Tong
8,916,448 B2 12/2014 Cheng et al.
9,171,756 B2 10/2015 Enquist et al.
9,184,125 B2 11/2015 Enquist et al.
9,263,186 B2 2/2016 Li et al.
9,331,149 B2 5/2016 Tong et al.
9,385,024 B2 7/2016 Tong et al.
9,391,143 B2 7/2016 Tong et al.
9,431,368 B2 8/2016 Enquist et al.
9,496,202 B2 11/2016 Hashimoto
9,496,239 B1 11/2016 Edelstein et al.
9,537,199 B2 * 1/2017 Dang et al. ..... H01P 5/02
10,002,844 B1 6/2018 Wang et al.
2002/0000328 A1 1/2002 Motomura et al.
2002/0003307 A1 1/2002 Suga
2005/0135041 A1 6/2005 Kang et al.
2005/0190808 A1 9/2005 Yonekura et al.
2005/0231303 A1 10/2005 Chang et al.
2006/0012966 A1 1/2006 Chakravorty
2006/0017144 A1 1/2006 Uematsu et al.
2006/0145778 A1 * 7/2006 Pleva et al. ..... H01P 5/107 333/26
2007/0147014 A1 6/2007 Chang et al.
2008/0124835 A1 5/2008 Chen et al.
2008/0150821 A1 6/2008 Koch et al.
2009/0052827 A1 2/2009 Durfee et al.
2009/0206962 A1 8/2009 Chou et al.
2011/0018657 A1 1/2011 Cheng et al.
2011/0115579 A1 * 5/2011 Rofougaran ..... H01P 1/20372 333/239
2012/0013499 A1 * 1/2012 Hayata ..... G01S 7/032 342/112
2012/0168217 A1 7/2012 Hsu et al.
2013/0063863 A1 3/2013 Timler et al.
2013/0105943 A1 5/2013 Lai et al.
2013/0207234 A1 8/2013 Ikeda et al.
2013/0265733 A1 * 10/2013 Herbsommer et al. ... H01P 3/16 361/774
2013/0286544 A1 10/2013 Azais
2014/0001568 A1 1/2014 Wang et al.
2014/0048908 A1 2/2014 Chen et al.
2014/0145338 A1 5/2014 Fujii et al.
2014/0175629 A1 6/2014 Sun et al.
2014/0184351 A1 * 7/2014 Bae et al. ..... H01P 3/122 333/34
2014/0252635 A1 9/2014 Tran et al.
2014/0264751 A1 9/2014 Chen et al.
2014/0264948 A1 9/2014 Chou et al.
2014/0370658 A1 12/2014 Tong et al.
2014/0377946 A1 12/2014 Cha et al.
2015/0097298 A1 4/2015 Chen et al.
2015/0194379 A1 7/2015 Chen et al.
2015/0206902 A1 7/2015 Cheng et al.
2015/0235952 A1 8/2015 Pan et al.
2015/0318618 A1 11/2015 Chen et al.
2016/0077294 A1 3/2016 Jou et al.
2016/0111404 A1 4/2016 Sanders et al.
2016/0155677 A1 6/2016 Bonart et al.
2016/0197630 A1 * 7/2016 Kawasaki ..... H01P 3/121 455/73
2016/0233195 A1 8/2016 Nagai
2016/0254345 A1 9/2016 Singh et al.
2016/0309578 A1 10/2016 Park
2016/0372449 A1 12/2016 Rusu et al.
2017/0062366 A1 3/2017 Enquist
2017/0062409 A1 3/2017 Basker et al.
2017/0179029 A1 6/2017 Enquist et al.
2017/0200711 A1 7/2017 Uzoh et al.
2017/0338214 A1 11/2017 Uzoh et al.
2017/0343498 A1 11/2017 Kalnitsky et al.
2018/0096931 A1 4/2018 Huang et al.
2018/0174995 A1 6/2018 Wang et al.
2018/0190580 A1 7/2018 Haba et al.
2018/0190583 A1 7/2018 DeLaCruz et al.
2018/0191047 A1 7/2018 Huang et al.
2018/0226375 A1 8/2018 Enquist et al.
2018/0286805 A1 10/2018 Huang et al.

FOREIGN PATENT DOCUMENTS

| | | |
|---|---|---|
| JP | 2001-102479 | 4/2001 |
| JP | 2002-353416 | 12/2002 |
| JP | 2003-043281 | 2/2003 |
| JP | 2008-258258 | 10/2008 |
| KR | 10-2006-0105797 | 10/2006 |
| WO | WO 2005/064646 A2 | 7/2005 |
| WO | WO 2012/125237 A2 | 9/2012 |

OTHER PUBLICATIONS

U.S. Appl. No. 15/379,942, filed Dec. 15, 2016, Enquist et al.
U.S. Appl. No. 15/387,385, filed Dec. 21, 2016, Wang et al.
U.S. Appl. No. 15/389,157, filed Dec. 22, 2016, Uzoh et al.
U.S. Appl. No. 15/426,942, filed Feb. 7, 2017, DeLaCruz et al.
Amirfeiz et al., "Formation of silicon structures by plasma-activated wafer bonding," Journal of the Electrochemical Society, 2000, vol. 147, No. 7, pp. 2693-2698.
Chung et al., "Room temperature GaAseu+Si and InPeu+Si wafer direct bonding by the surface activate bonding method," Nuclear Instruments and Methods in Physics Research Section B: Beam Interactions with Materials and Atoms, Jan. 2, 1997, vol. 121, Issues 1-4, pp. 203-206.
Chung et al., "Wafer direct bonding of compound semiconductors and silicon at room temperature by the surface activated bonding

(56) References Cited

OTHER PUBLICATIONS method," Applied Surface Science, Jun. 2, 1997, vols. 117-118, pp. 808-812.
Farrens et al., "Chemical free room temperature wafer to wafer direct bonding," J. Electrochem. Soc., The Electrochemical Society, Inc., Nov. 1995, vol. 142, No. 11. pp. 3949-3955.
Farrens et al., "Chemical free wafer bonding of silicon to glass and sapphire," Electrochemical Society Proceedings vol. 95-7, 1995, pp. 72-77.
Gösele et al., "Semiconductor Wafer Bonding: A flexible approach to materials combinations in microelectronics; micromechanics and optoelectronics," IEEE, 1997, pp. 23-32.
Hosoda et al., "Effect of the surface treatment on the room-temperature bonding of Al to Si and SiO2," Journal of Materials Science, Jan. 1, 1998, vol. 33, Issue 1, pp. 253-258.
Hosoda et al., "Room temperature GaAs—Si and InP—Si wafer direct bonding by the surface activated bonding method," Nuclear Inst. and Methods in Physics Research B, 1997, vol. 121, Nos. 1-4, pp. 203-206.
Howlader et al., "A novel method for bonding of ionic wafers," Electronics Components and Technology Conference, 2006, IEEE, pp. 7-pp.
Howlader et al., "Bonding of p-Si/n-InP wafers through surface activated bonding method at room temperature," Indium Phosphide and Related Materials, 2001, IEEE International Conference on, pp. 272-275.
Howlader et al., "Characterization of the bonding strength and interface current of p-Si/ n-InP wafers bonded by surface activated bonding method at room temperature," Journal of Applied Physics, Mar. 1, 2002, vol. 91, No. 5, pp. 3062-3066.
Howlader et al., "Investigation of the bonding strength and interface current of p-SionGaAs wafers bonded by surface activated bonding at room temperature," J. Vac. Sci. Technol. B 19, Nov./Dec. 2001, pp. 2114-2118.
Itoh et al., "Characteristics of fritting contacts utilized for micromachined wafer probe cards," 2000 American Institute of Physics, AIP Review of Scientific Instruments, vol. 71, 2000, pp. 2224.
Itoh et al., "Characteristics of low force contact process for MEMS probe cards," Sensors and Actuators A: Physical, Apr. 1, 2002, vols. 97-98, pp. 462-467.
Itoh et al., "Development of MEMS IC probe card utilizing fritting contact," Initiatives of Precision Engineering at the Beginning of a Millennium: 10th International Conference on Precision Engineering (ICPE) Jul. 18-20, 2001, Yokohama, Japan, 2002, Book Part 1, pp. 314-318.
Itoh et al., "Room temperature vacuum sealing using surface activated bonding method," The 12th International Conference on Solid State Sensors, Actuators and Microsystems, Boston, Jun. 8-12, 2003, 2003 IEEE, pp. 1828-1831.
Kim et al., "Low temperature direct Cu—Cu bonding with low energy ion activation method," Electronic Materials and Packaging, 2001, IEEE, pp. 193-195.
Kim et al., "Room temperature Cu—Cu direct bonding using surface activated bonding method," J. Vac. Sci. Technol., 2003 American Vacuum Society, Mar./Apr. 2003, vol. 21, No. 2, pp. 449-453.
Kim et al., "Wafer-scale activated bonding of Cu—Cu, Cu—Si, and Cu—SiO2 at low temperature," Proceedings—Electrochemical Society, 2003, vol. 19, pp. 239-247.
Matsuzawa et al., "Room-temperature interconnection of electroplated Au microbump by means of surface activated bonding method," Electornic Components and Technology Confererence, 2001, 51st Proceedings, IEEE, pp. 384-387.
Onodera et al., "The effect of prebonding heat treatment on the separability of Au wire from Ag-plated Cu alloy substrate," Electronics Packaging Manufacturing, IEEE Transactions, Jan. 2002, vol. 25, Issue 1, pp. 5-12.
Reiche et al., "The effect of a plasma pretreatment on the Si/Si bonding behaviouir," Electrochemical Society Proceedings, 1998, vol. 97-36, pp. 437-444.
Roberds et al., "Low temperature , in situ, plasma activated wafer bonding," Electrochecmical Society Proceedings, 1997, vol. 97-36, pp. 598-606.
Shigetou et al., "Room temperature bonding of ultra-fine pitch and low-profiled Cu electrodes for bump-less interconnect," 2003 Electronic Components and Technology Conference, pp. 848-852.
Shigetou et al., "Room-temperature direct bonding of CMP—Cu film for bumpless interconnection," Electronic Components and Technology Confererence, 51st Proceedings, 2001, IEEE, pp. 755-760.
Shingo et al., "Design and fabrication of an electrostatically actuated MEMS probe card," Tranducers, Solid-State Sensors, Actuators and Microsystems, 12th International Conference, Jun. 8-12, 2003, vol. 2, pp. 1522-1525.
Suga et al., "A new approach to Cu—Cu direct bump bonding," IEMT/IMC Symposium, 1997, Joint International Electronic Manufacturing Symposium and the International Microelectronics Conference, Apr. 16-18, 1997, IEEE, pp. 146-151.
Suga et al., "A new bumping process using lead-free solder paste," Electronics Packaging Manufacturing, IEEE Transactions on (vol. 25, Issue 4), IEEE, Oct. 2002, pp. 253-256.
Suga et al., "A new wafer-bonder of ultra-high precision using surface activated bonding (SAB) concept," Electronic Components and Technology Conference, 2001, IEEE, pp. 1013-1018.
Suga et al., "Bump-less interconnect for next generation system packaging," Electronic Components and Technology Conference, 2001, IEEE, pp. 1003-1008.
Suga, T., "Feasibility of surface activated bonding for ultra-fine pitch interconnection—A new concept of bump-less direct bonding for system level packaging," The University of Tokyo, Research Center for Science and Technology, 2000 Electronic Components and Technology Conference, 2000 IEEE, pp. 702-705.
Suga, T., "Room-temperature bonding on metals and ceramics," Proceedings of the Second International Symposium on Semiconductor Wafer Bonding: Science, Technology and Applications, The Electrochemical Society Proceedings, vol. 93-29 (1993), pp. 71-80.
Suga et al., "Surface activated bonding—an approach to joining at room temperature," Ceramic Transactions: Structural Ceramics Joining II, The American Ceramic Society, 1993, pp. 323-331.
Suga et al., "Surface activated bonding for new flip chip and bumpless interconnect systems," Electronic Components and Technology Conference, 2002, IEEE, pp. 105-111.
Suga, "UHV room temperature joining by the surface activated bonding method," Advances in science and technology, Techna, Faenza, Italie, 1999, pp. C1079-C1089.
Takagi et al., "Effect of surface roughness on room-temperature wafer bonding by Ar beam surface activation," Japanese Journal of Applied Physics, 1998, vol. 37, Part 1, No. 1, pp. 4197.
Takagi et al., "Low temperature direct bonding of silicon and silicon dioxide by the surface activation method," Solid State Sensors and Actuators, 1997, Transducers'97 Chicago, 1997 International Conference, vol. 1, pp. 657-660.
Takagi et al., "Room-temperature bonding of lithium niobate and silicon wafers by argon-beam surface activation," Appl. Phys. Lett., 1999. vol. 74, pp. 2387.
Takagi et al., "Room temperature silicon wafer direct bonding in vacuum by Ar beam irradiation," Micro Electro Mehcanical Systems, MEMS '97 Proceedings, 1997, IEEE, pp. 191-196.
Takagi et al., "Room-temperature wafer bonding of Si to LiNbO3, LiTaO3 and Gd3Ga5O12 by Ar-beam surface activation," Journal of Micromechanics and Microengineering, 2001, vol. 11, No. 4, pp. 348.
Takagi et al., "Room-temperature wafer bonding of silicon and lithium niobate by means of arbon-beam surface activation," Integrated Ferroelectrics: An International Journal, 2002, vol. 50, Issue 1, pp. 53-59.
Takagi et al., "Surface activated bonding silicon wafers at room temperature," Appl. Phys. Lett. 68, 2222 (1996).
Takagi et al, "Wafer-scale room-temperature bonding between silicon and ceramic wafers by means of argon-beam surface activation," Micro Electro Mechanical Systems, 2001, MEMS 2001, The 14th IEEE International Conference, Jan. 25, 2001, IEEE, pp. 60-63.

(56) References Cited

OTHER PUBLICATIONS

Takagi et al., "Wafer-scale spontaneous bonding of silicon wafers by argon-beam surface activation at room temperature," Sensors and Actuators A: Physical, Jun. 15, 2003, vol. 105, Issue 1, pp. 98-102.
Tong et al., "Low temperature wafer direct bonding," Journal of Microelectomechanical systems, Mar. 1994, vol. 3, No. 1, pp. 29-35.
Topol et al., "Enabling technologies for wafer-level bonding of 3D MEMS and integrated circuit structures," 2004 Electronics Components and Technology Conference, 2004 IEEE, pp. 931-938.
Wang et al., "Reliability and microstructure of Au—Al and Au—Cu direct bonding fabricated by the Surface Activated Bonding," Electronic Components and Technology Conference, 2002, IEEE, pp. 915-919.
Wang et al., "Reliability of Au bump—Cu direct interconnections fabricated by means of surface activated bonding method," Microelectronics Reliability, May 2003, vol. 43, Issue 5, pp. 751-756.
Weldon et al., "Physics and chemistry of silicon wafer bonding investigated by infrared absorption spectroscopy," Journal of Vacuum Science & Technology B, Jul./Aug. 1996, vol. 14, No. 4, pp. 3095-3106.
Xu et al., "New Au—Al interconnect technology and its reliability by surface activated bonding," Electronic Packaging Technology Proceedings, Oct. 28-30, 2003, Shanghai, China, pp. 479-483.
Ceramic Microstructures: Control at the Atomic Level, Recent Progress in Surface Activated Bonding, 1998, pp. 385-389.
U.S. Appl. No. 15/849,383, filed Dec. 20, 2017, Enquist et al.
U.S. Appl. No. 15/856,391, filed Dec. 28, 2017, Haba et al.
U.S. Appl. No. 15/940,273, filed Mar. 29, 2018, Huang et al.
International Search Report and Written Opinion dated May 29, 2017, issued in International Application No. PCT/US2016/067182, 14 pages.
International Search Report and Written Opinion dtaed Apr. 23, 2018, issued in International Application No. PCT/US2017/068788, 13 pages.
International Search Report and Written Opinion dated Jan. 9, 2018, issued in International Application No. PCT/US2017/052409, 19 pages.
International Search Report and Written Opinion dated Mar. 22, 2018, issued in International Application No. PCT/US2017/064735, 13 pages.
International Search Report and Written Opinion dated Jul. 17, 2018, issued in International Application No. PCT/US2018/025241, 15 pages.

* cited by examiner

STRUCTURE COMPRISING AT LEAST A FIRST ELEMENT BONDED TO A CARRIER HAVING A CLOSED METALLIC CHANNEL WAVEGUIDE FORMED THEREIN

BACKGROUND

Field

The field relates to structures with integrated waveguides, and in particular, to interconnects and circuit structures with integrated metallic waveguides.

Description of the Related Art

In some electronic systems, multiple integrated device dies may be mounted to a carrier and may communicate with one another in a variety of ways. For example, in some systems, two integrated device dies can communicate with one another by way of conductive traces or interconnects provided in an intervening package substrate such as a printed circuit board (PCB) or in a silicon interposer. In other systems, a silicon bridge or other interconnect structure can serve to electrically connect two dies within a package or system. However, existing die-to-die interconnects may experience high losses due to conductor loss, crosstalk or other factors. Accordingly, there remains a continuing need for improved die-to-die communications.

DETAILED DESCRIPTION OF THE DISCLOSURE

Various embodiments disclosed herein relate to interconnects and structures with integrated waveguides, e.g., integrated conductive or metallic waveguides. As explained above, existing techniques for providing die-to-die (or chip-to-chip) communications within a package or system may not provide adequate performance at high frequencies. For example, some die-to-die interconnects may experience high current densities which can lead to high losses due to conductor loss, crosstalk and other factors. Moreover, in some systems, it may be difficult to provide millimeter wave or sub-terahertz communications over a range of tens of gigahertz to hundreds of gigahertz (e.g., in a range of 10 GHz to 950 GHz, in a range of 20 GHz to 900 GHz) using coplanar or microstrip waveguides since such devices may be lossy at millimeter-sized wavelengths. The embodiments disclosed herein beneficially enable the use of lower loss metallic waveguides for die-to-die communications, including communications at wavelengths in a range of 0.1 mm to 10 mm.

A metallic or conductive waveguide can comprise an effectively closed metallic or conductive channel as viewed from a side cross-section taken perpendicular to a propagation direction of the waveguide, and can include a low loss dielectric material within the effectively closed channel. In various embodiments, the metallic or conductive waveguide can comprise a metal, including metallic compounds. In some embodiments, the metallic waveguide can be defined by bonding two elements (e.g., two semiconductor elements) along an interface, with the waveguide defined at least in part by the interface. In some embodiments, the two elements can be directly bonded to one another without an intervening adhesive. In other embodiments, the metallic waveguide can be at least partially (e.g., completely) embedded in an element and can include one or a plurality of ports that can receive a radiating element for coupling electromagnetic waves to the waveguide. The disclosed embodiments can therefore provide die-to-die communications with low loss and with little or no crosstalk, which can enable high frequency die-to-die communications. Moreover, in embodiments that utilize direct bonding, the resulting structure can be constructed at lower costs than other techniques, since the waveguides can be constructed using the bonding layers defined for directly bonding two elements to one another. The integrated waveguides disclosed herein can also advantageously reduce the number of radio frequency (RF) components provided in the package, since the waveguides described herein can be directly integrated into the dies and/or other elements.

Figure 1:
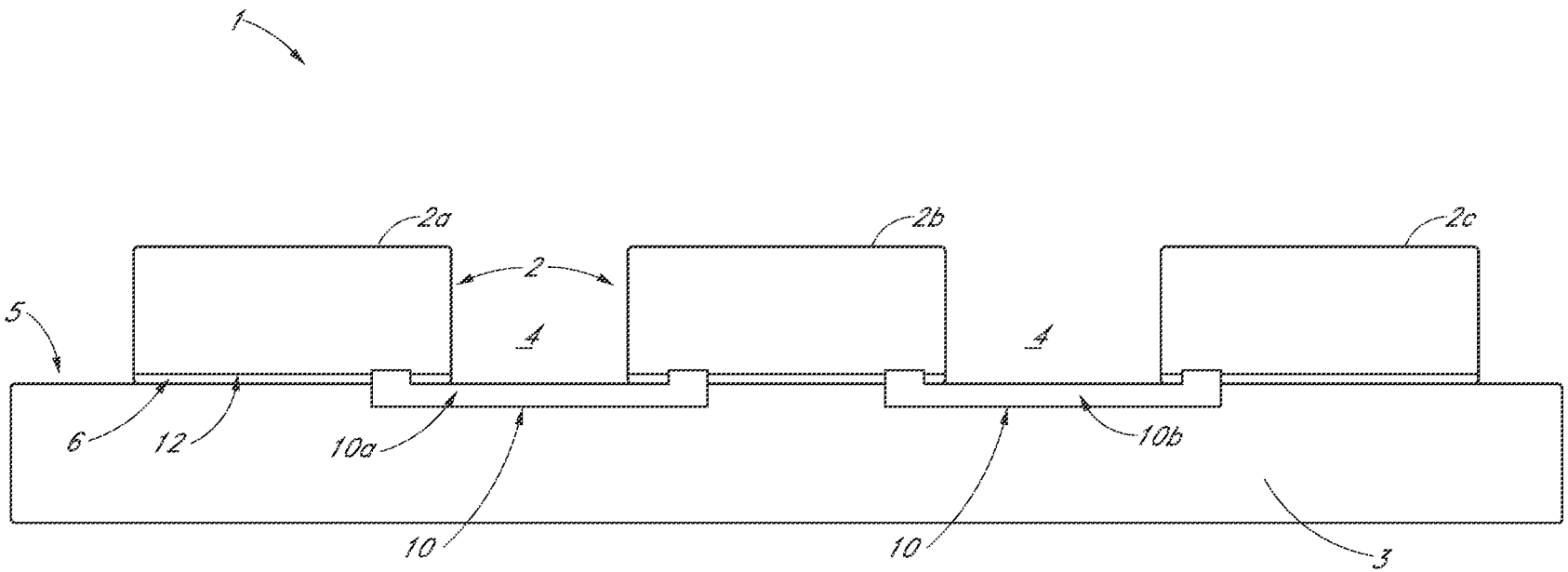
FIG. 1 is a schematic side sectional view of a structure that includes integrated waveguides, according to some embodiments.

FIG. 1 is a schematic side sectional view of a structure 1 that includes an integrated waveguide 10 (e.g., an integrated metallic or otherwise conductive waveguide), according to some embodiments. The structure 1 can include a plurality of elements 2 mounted to another element, e.g., a carrier 3. For example, in FIG. 1, the elements 2 can comprise a first integrated device die 2*a*, a second integrated device die 2*b*, and a third integrated device die 2*c*, each of which are electrically and mechanically connected to the carrier 3. In various embodiments, the device dies 2*a*-2*c* can comprise processor dies, memory dies, sensor dies, communications dies, microelectromechanical systems (MEMS) dies, or any other suitable type of device. The carrier 3 may be any suitable type of element, such as an integrated device die, an interposer, a reconstituted die or wafer, etc. As explained herein, the elements 2*a*-2*c* are shown as being mounted to the carrier 3 by way of a direct bond, but in other embodiments, the elements can be connected to the carrier in other ways. In the illustrated embodiment, the elements 2*a*-2*c* and the carrier 3 comprise semiconductor elements (e.g., integrated device dies 2*a*-2*c*, a semiconductor interposer, etc.), but in other embodiments, the elements and/or the carrier can comprise other types of elements that may or may not comprise a semiconductor material, such as various types of optical devices (e.g., lenses, filters, etc.). As shown, the dies 2*a*-2*c* can be laterally spaced from one another along the carrier 3.

In the illustrated embodiment, one or more of the device dies 2*a*-2*c* are directly bonded to the carrier 3 without an intervening adhesive. The direct bond between the dies 2*a*-2*c* and the carrier 3 can include a direct bond between corresponding conductive features of the dies 2*a*-2*c* (e.g., a processor die) and the carrier 3 (e.g., an integrated device die, an interposer, etc.) without an intervening adhesive, without being limited thereto. In some embodiments, the conductive features may be surrounded by non-conductive field regions. To accomplish the direct bonding, in some embodiments, respective bonding surfaces of the conductive features and the non-conductive field regions can be prepared for bonding. Preparation can include provision of a nonconductive layer, such as silicon oxide or silicon nitride, with exposed conductive features, such as metal bond pads or contacts. The bonding surfaces of at least the nonconductive field regions, or both the conductive and nonconductive regions, can be polished to a very high degree of smoothness (e.g., less than 20 nm surface roughness, or more particularly, less than 5 nm surface roughness). In some embodiments, the surfaces to be bonded may be terminated with a suitable species and activated prior to bonding. For example, in some embodiments, the nonconductive surfaces (e.g., field regions) of the bonding layer to be bonded, such as silicon oxide material, may be very slightly etched for activation and exposed to a nitrogen-containing solution and terminated with a nitrogen-containing species. As one example, the surfaces to be bonded (e.g., field regions) may be exposed to an ammonia dip after a very slight etch, and/or a nitrogen-containing plasma (with or without a separate etch). In a direct bond interconnect (DBI) process, nonconductive features of the dies and the carrier can directly bond to one another, even at room temperature and without the application of external pressure, while the conductive features of the dies and the carrier layer can also directly bond to one another, without any intervening adhesive layers. Bonding by DBI forms stronger bonds than Van der Waals bonding, including significant covalent bonding between the surfaces of interest. Subsequent annealing can further strengthen bonds, particularly between conductive features of the bonding interfaces.

In some embodiments, the respective conductive features can be flush with the exterior surfaces (e.g., the field regions) of the dies and the carrier. In other embodiments, the conductive features may extend above the exterior surfaces. In still other embodiments, the conductive features of one or both of the dies and the carrier are recessed relative to the exterior surfaces (e.g., nonconductive field regions) of the dies and the carrier. For example, the conductive features can be recessed relative to the field regions by less than 20 nm, e.g., less than 10 nm.

Once the respective surfaces are prepared, the nonconductive field regions (such as silicon oxide) of the dies 2*a*-2*c* can be brought into contact with corresponding nonconductive regions of the carrier 3. The interaction of the activated surfaces can cause the nonconductive regions of the dies 2*a*-2*c* to directly bond with the corresponding nonconductive regions of the carrier 3 without an intervening adhesive, without application of external pressure, without application of voltage, and at room temperature. In various embodiments, the bonding forces of the nonconductive regions can include covalent bonds that are greater than Van der Waals bonds and exert significant forces between the conductive features. Prior to any heat treatment, the bonding energy of the dielectric-dielectric surface can be in a range from 150-300 $mJ/m^2$, which can increase to 1500-4000 $mJ/m^2$ after a period of heat treatment. Regardless of whether the conductive features are flush with the nonconductive regions, recessed or protrude, direct bonding of the nonconductive regions can facilitate direct metal-to-metal bonding between the conductive features. In various embodiments, the dies 2*a*-2*c* and the carrier 3 may be heated after bonding at least the nonconductive regions. As noted above, such heat treatment can strengthen the bonds between the nonconductive regions, between the conductive features, and/or between opposing conductive and non-conductive regions. In embodiments where one or both of the conductive features are recessed, there may be an initial gap between the conductive features of the dies 2*a*-2*c* and the carrier 3, and heating after initially bonding the nonconductive regions can expand the conductive elements to close the gap. Regardless of whether there was an initial gap, heating can generate or increase pressure between the conductive elements of the opposing parts, aid bonding of the conductive features and form a direct electrical and mechanical connection.

Additional details of the direct bonding processes used in conjunction with each of the disclosed embodiments may be found throughout U.S. Pat. Nos. 7,126,212; 8,153,505; 7,622,324; 7,602,070; 8,163,373; 8,389,378; and 8,735,219, and throughout U.S. Patent Application Nos. 14/835,379; (issued as U.S. Pat. No. 9,953,941); 62/278,354; 62/303,930; and 15/137,930, (published as US 2016/0314346), the contents of each of which are hereby incorporated by reference herein in their entirety and for all purposes.

Direct bonding of the dies 2*a*-2*c* to the carrier 3 can result in a bond interface 6 between the elements 2 and the carrier 3. The waveguide 10 can be defined along the interface 6 between the carrier 3 and the elements 2 (the dies 2*a*-2*c*). For example, as explained herein, the waveguide 10 can comprise a first waveguide portion 10*a* that is defined by features at the respective lower surfaces 12 of the elements 2 and at an upper surface 5 of the carrier 3. As explained below in connection with FIGS. 3A-3C and 4A-4C, metallic and/or dielectric features exposed on the lower surfaces 12 of the dies 2*a*-2*c* (the elements 2) can cooperate with corresponding metallic and/or dielectric features exposed on the upper surface 5 of the carrier 3 to define the first waveguide portion 10*a* of the waveguide 10. The waveguide 10 can also comprise a second waveguide portion 10*b* disposed along gaps 4 between the integrated device dies 2*a*-2*c*. The second waveguide portion 10*b* can be embedded in the carrier 3 and can be defined by a metallic channel at or near the upper surface 5. The waveguide 10 can enable die-to-die communications between the first die 2*a* and the second die 2*b*, and between the second die 2*b* and the third die 2*c*. Although three dies 2*a*-2*c* are illustrated in FIG. 1, it should be appreciated that any suitable number of dies may be provided and may communicate with one another. Moreover, as explained above, the integrated waveguide 10 disclosed herein can be used in conjunction with any suitable type of element. In addition, although the dies 2*a*-2*c* are directly bonded to the carrier 3 without an intervening adhesive in the illustrated embodiment, in other embodiments, the dies 2*a*-2*c* can be bonded to the carrier 3 in other ways, such as by way of a conductive adhesive, solder, etc.

Figure 2:
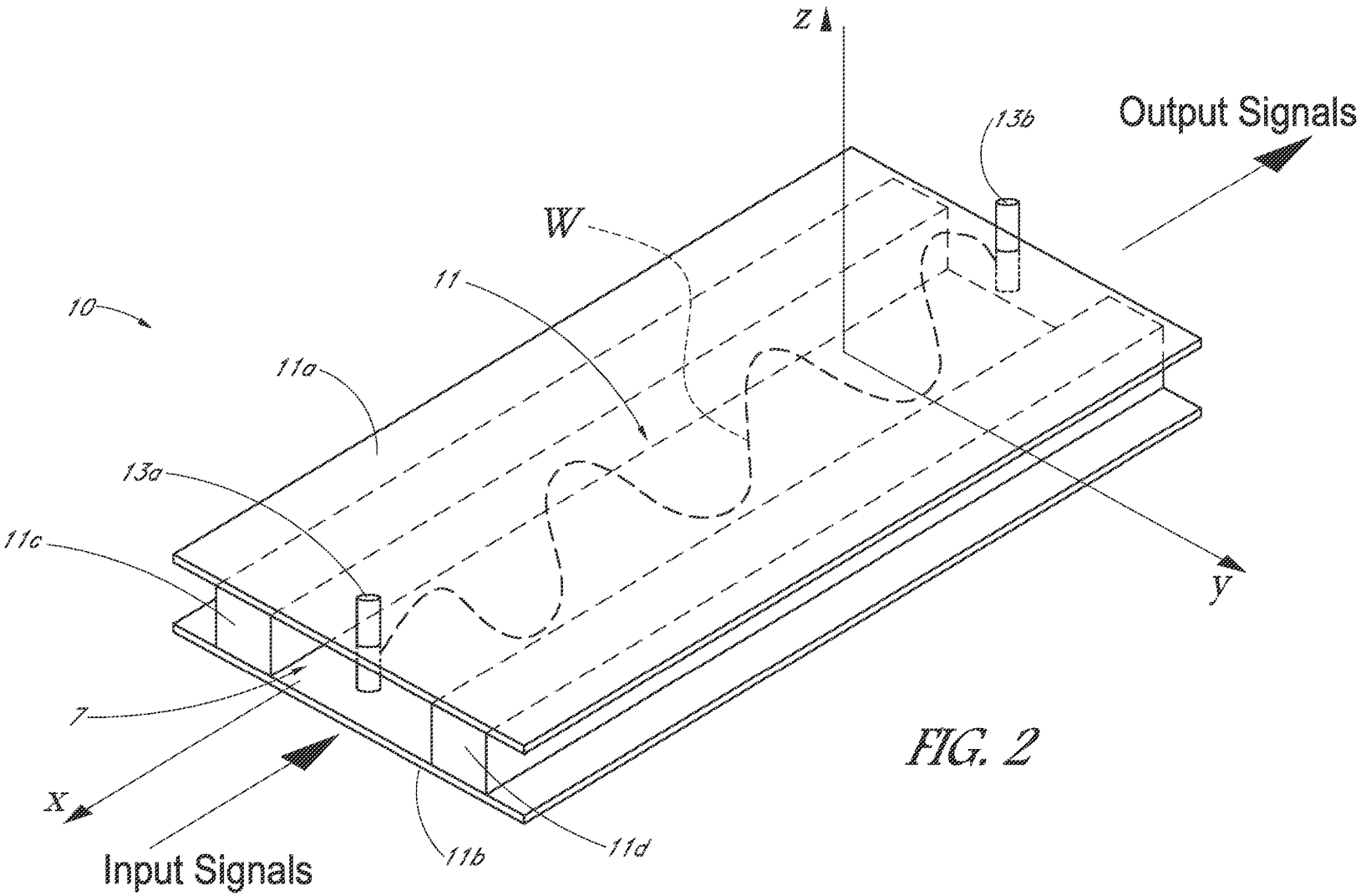
FIG. 2 is schematic perspective view of a waveguide according to various embodiments.

FIG. 2 is schematic perspective view of a portion of the waveguide 10 according to various embodiments. The waveguide 10 shown in FIG. 2 is a metallic waveguide that has a polygonal, and particularly rectangular, cross-section. For example, the waveguide 10 can comprise a channel 11 defined by a plurality of metallic walls 11*a*, 11*b*, 11*c* and 11*d* that cooperate to delimit an effectively closed cross-sectional profile, as viewed along a cross-section taken transverse to the propagation direction (i.e., the x-axis). A dielectric material 7 can be disposed within the effectively closed metallic channel 11. In FIG. 2, the side section of the channel 11 is completely closed such that the walls 11*a*-11*d* define a continuous, closed boundary about the dielectric material 7. As explained below, however, in some embodiments, the effectively closed metallic channel 11 may have gaps or spaces in portions of some of the walls 11*a*-11*d*. In various embodiments, the metallic walls 11*a*-11*d* of the channel 11 can comprise copper or other metal materials. The dielectric material 7 can comprise any suitable dielectric, such as silicon oxide.

The walls 11*a*-11*d* can be electrically grounded so as to provide a bounded pathway along which electromagnetic waves can propagate. As shown in FIG. 2, input signals or waves W can enter at a first end of the waveguide 10 and can propagate parallel to the x-axis and can exit as an output signal at another end of the waveguide 10. In various embodiments, radiating elements 13*a*, 13*b* can be provided at both ends of the waveguide 10 to transmit and/or receive electromagnetic waves W along the waveguide 10. In various embodiments the width of the waveguide 10 along the y-direction can define the cutoff frequency for the propagating mode. During operation, a first radiating element 13*a* can radiate signals or waves W at frequencies that can propagate along the waveguide 10. In some embodiments, the radiating elements 13*a*, 13*b* can comprise conductive segments or probes inserted into the dielectric material 7 within the channel 11. Skilled artisans will understand that electromagnetic waves can be coupled to the waveguide 10 in other suitable ways. For example, in some embodiments, the radiating elements 13*a*, 13*b* can comprise a conductive loop with the plane of the loop perpendicular to the lines of magnetic force, a linear conductor or probe that is parallel to the lines of electric force, or an aperture in a side wall of the waveguide 10 disposed along the direction of the lines of magnetic force on the side wall. The signals or waves W can propagate along the waveguide 10 and can be received by another radiating element 13*b* which can convert the waves W to an electrical current. Beneficially, as explained herein, the waveguide 10 can be integrated or embedded in an element (such as an interposer or integrated device die), or at the bond interface 6 between two elements (e.g., at the interface 6 between the dies 2*a*-2*c* and the carrier 3 as shown, for example, in FIG. 1). Moreover, in the illustrated embodiment, the waveguide 10 is straight or generally linear as it extends between two dies. However, in other embodiments, any of the waveguides 10 disclosed herein may bend, curve, or otherwise change directions so as to guide the waves to any desirable location in the structure 1.

Figure 3A:
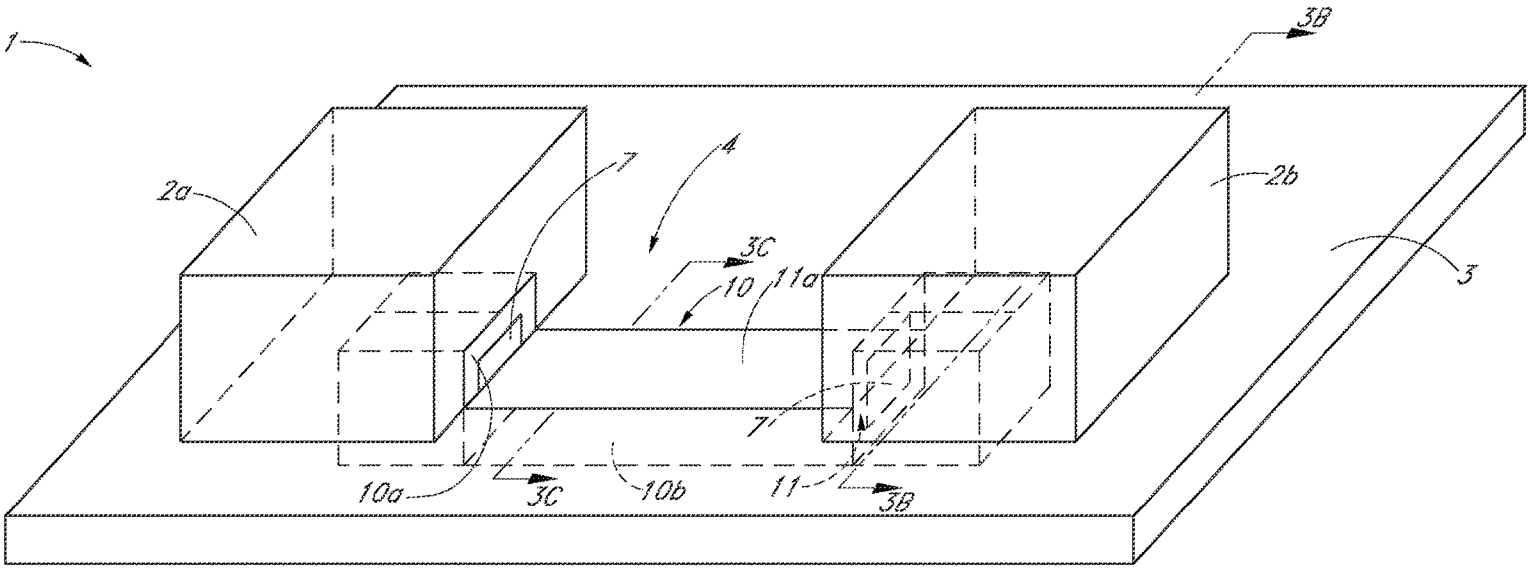
FIG. 3A is a schematic perspective view of a structure with an integrated waveguide, according to various embodiments.
Figure 3B:
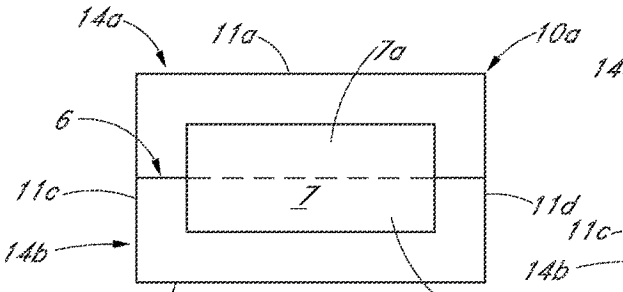
FIG. 3B is a schematic side cross-sectional view of a first waveguide portion disposed between integrated device dies and a carrier taken along line 3B-3B of FIG. 3A.
Figure 3C:
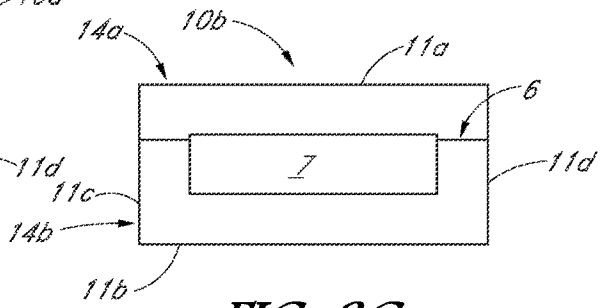
FIG. 3C is a schematic side cross-sectional view a second waveguide portion disposed along and under a gap between the integrated device dies taken along line 3C-3C of FIG. 3A.

FIG. 3A is a schematic perspective view of a structure 1 with an integrated waveguide 10, according to various embodiments. FIG. 3B is a schematic side cross-sectional view of the first waveguide portion 10*a* disposed at interfaces 6 between the dies 2*a*, 2*b* and the carrier 3 shown in FIG. 3A. FIG. 3C is a schematic side cross-sectional view of the second waveguide portion 10*b* disposed along and under the gap 4 between the dies 2*a*, 2*b*. shown in FIG. 3A. As explained above, in some embodiments, the waveguide 10 can include the first waveguide portion 10*a* defined at the interfaces 6 between the dies 2*a*-2*b* and the carrier 3, as shown in FIG. 3B. For example, as shown at least in FIG. 3A-3B, the first waveguide portion 10*a* can be defined by first metallic features 14*a* and first dielectric features 7*a* formed in and/or on the respective integrated device dies 2*a*, 2*b*, and second metallic features 14*b* and second dielectric features 7*b* formed in and/or on the carrier 3.

The first waveguide portion 10*a* can be formed in any suitable manner, such as by damascene processes. In the arrangement illustrated in FIG. 3B, for example, trenches or recesses can be defined in the lower surfaces 12, (see, for example, FIG. 1), which may be the active surfaces, of the dies 2*a*-2*b* and in the upper surface 5 (see, for example, FIG. 1) of the carrier 3. A metallic layer can be deposited along the bottom and sidewalls of the trenches to define the first and second metallic feature 14*a*, 14*b*. The dielectric features 7*a*, 7*b* can be deposited within the trenches over the metallic features 14*a*, 14*b* in the dies 2*a*, 2*b* and the carrier 3. The upper surface 5 of the carrier 3 and the lower surface 12 of the dies 2*a*, 2*b* can be prepared for direct bonding as explained above. For example, the upper surface 5 and the lower surface 12 can be polished to a very high surface smoothness, and can be activated and terminated with a suitable species (e.g., nitrogen). In some embodiments, the metallic features 14*a*, 14*b* may be recessed relative to the dielectric features 7*a*, 7*b* (e.g., recessed below the dielectric features 7*a*, 7*b* by less than 20 nm, or by less than 10 nm). The lower surfaces 12 of the dies 2*a*, 2*b* can be brought into contact with the upper surface 5 of the carrier 3 at room temperature to form a direct bond between at least the non-conductive field regions of the dies 2*a*, 2*b* and the carrier 3 (e.g., a direct bond between the dielectric features 7*a*, 7*b* disposed in each element). The non-conductive regions can be directly bonded without application of pressure or voltage in some arrangements. In some embodiments, the structure 1 can be heated to increase the bond strength and/or to cause the metallic features 14*a*, 14*b* to form an electrical contact with one another.

The resulting bonded structure 1 can be bonded along the interface 6, and the waveguide 10 can be defined at least in part along the bond interface 6. For example, the first and second metallic features 14*a*, 14*b* and the associated dielectric features 7*a*, 7*b* can cooperate along the interface 6 to form the first waveguide portion 10*a* of the waveguide 10. In particular, the first and second metallic features 14*a*, 14*b* can bond to one another such that the walls 11*c*, 11*d* can be formed from respective side portions of the features 14*a*, 14*b* (e.g., the portions of the metal that line the sidewalls of the trenches in the elements). The walls 11*a*, 11*b* can be defined by the portions of the metal that line the bottoms of the trenches in the respective elements. As shown in the side sectional view of FIG. 3B, the metallic features 14*a*, 14*b* can cooperate to define an effectively closed metallic channel (e.g., a completely closed metallic channel in the arrangement of FIG. 3B) disposed about the dielectric material 7 (which is defined by the respective dielectric features 7*a*, 7*b*). Beneficially, the direct bond between the metallic features 14*a*, 14*b* and between the dielectric features 7*a*, 7*b* can enable face down solutions (e.g., with each die's active surface facing the carrier 3) for die-to-die communications with improved electrical performance and lower losses for frequencies below 1 THz (e.g., greater than 22 GHz, or in a range of 22 GHz to 1 THz), as compared with other die-to-die interconnects.

Turning to FIG. 3C, in the illustrated embodiment, the second waveguide portion 10*b* can be defined along and underlying the gaps 4 between the dies 2*a*, 2*b* (see, for example, FIG. 3A). In the second waveguide portion 10*b*, the channel 11 (see, forexample, FIG. 3A) can be defined by the second metallic portion 14*b* formed in the carrier 3 (see, for example, FIG.3A) and by a first metallic portion 14*a* that can be deposited or adhered over the second metallic portion 14*b* and the dielectric material 7. As with FIG. 3B, the first and second metallic portions 14*a*, 14*b* may be separately defined or integrated so as to cooperate to define the waveguide portion 10*b*. The second waveguide portion 10*b* can accordingly be embedded or buried in the carrier 3, with the upper wall 11*a* defined by metal applied over the upper surface 5 of the carrier 3. The height of the second waveguide portion 10*b* along the z-axis (see FIG. 2) can be less than the height of the first waveguide portion 10*a* along the z-axis, as shown in FIGS. 3B and 3C. The height differential between the first and second waveguide portions 10*a*, 10*b* may introduce some impedance discontinuities, but the overall effect on electrical performance is negligible. The width of the first and second waveguide portions 10*a*, 10*b* along the y-axis (see FIG. 2) may be substantially the same, which can ensure effective propagation along the x-axis. Beneficially, the second waveguide portion 10*b* can be embedded within a carrier 3, which can be a semiconductor element (such as an interposer, an integrated device die, a reconstituted die or wafer, etc.) in the illustrated embodiment.

Figures 4A, 4B, 4C:
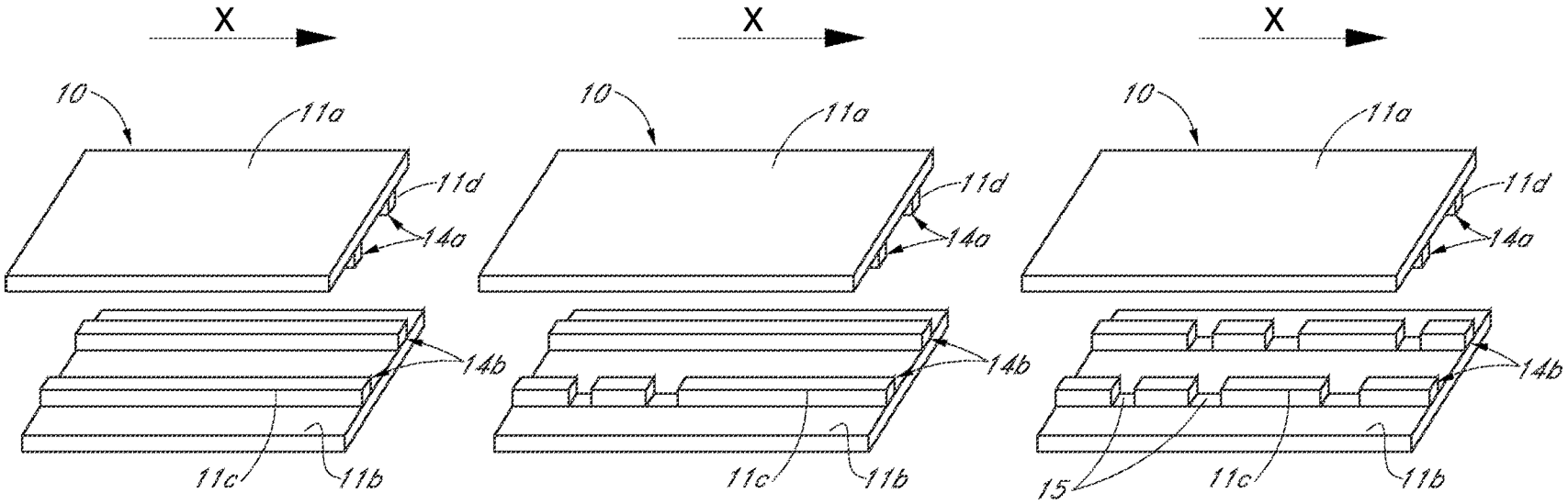
FIG. 4A is a schematic perspective view of a waveguide with metallic features that comprise continuous segments, prior to bonding.
FIG. 4B is a schematic perspective view of a waveguide in which portions of conductive features are patterned with discontinuities or gaps to avoid dishing.
FIG. 4C is a schematic perspective view of a waveguide in which both conductive features are patterned with discontinuities or gaps along their lengths to avoid dishing.

FIGS. 4A-4C are schematic perspective views of waveguides 10 with different metallic patterns for the metallic channel 11. In particular, FIG. 4A is a schematic perspective view of a waveguide 10 which can be similar to the waveguide 10 shown in FIG. 2, prior to bonding. In FIG. 4A, for example, first metallic features 14*a* can include the wall 11*a* and metallic legs that are disposed on and/or extend from the wall 11*a* to at least partially define the walls 11*c*, 11*d*, and which can be provided on a first element (such as the dies 2*a*-2*c*). Second metallic features 14*b* can include the wall 11*b* and metallic legs that are disposed on and/or extend from the wall 11*b* to at least partially define the walls 11*c*, 11*d*, and which can be provided on a second element (such as the carrier 3). The metallic features 14*a*, 14*b* can be directly bonded to one another to define the walls 11*c*, 11*d*. In the embodiment of FIG. 4A, the metallic features 14*a*, 14*b* comprise a continuous linear metallic segments such that, when the features 14*a*, 14*b* are directly bonded to one another, the walls 11*a*-11*d* define a channel 11 (see, for example, FIG. 2 and 3A) that is effectively closed (e.g., completely closed) as viewed from a cross-section taken perpendicular to the propagation direction (e.g., the x-axis). Although not illustrated in FIG. 4A, it should be appreciated that corresponding dielectric features 7*a*, 7*b* (see FIG. 3B) can also be directly bonded so as to define the dielectric material 7 disposed within the metallic channel 11 defined by the walls 11*a*-11*d*. Furthermore, although the waveguide 10 shown in FIG. 4A is straight or linear, in other embodiments, the waveguide 10 can bend, turn, or curve so as to cause the waves W to follow a curved or angled pathway.

In some arrangements, it may be undesirable to provide continuous linear segments, such as the metallic features 14*a*, 14*b* shown in FIG. 4A. For example, in some cases, polishing the metallic features 14*a*, 14*b* and dielectric features 7*a*, 7*b* using processes such as chemical mechanical polishing can cause dishing along the bonding surfaces of the elements to be bonded. The dishing can cause uneven surfaces along the bonding surfaces, which may be undesirable. Thus, in some embodiments, the metallic features 14*a*, 14*b* that define the walls 11*c*, 11*d* of the channel 11 may instead be patterned to define smaller metallic features that are less susceptible to dishing.

Accordingly, FIG. 4B is a schematic perspective view of a waveguide 10 in which portions of conductive features 14*a*, 14*b* are patterned with discontinuities or gaps 15 (see, for example, FIG. 4C) to avoid dishing. FIG. 4C is a schematic perspective view of a waveguide 10 in which both metallic features 14*a*, 14*b* are patterned with discontinuities or gaps 15 along their lengths to avoid dishing. Unlike FIG. 4A, in FIGS. 4B and 4C, the metallic features 14*a*, 14*b* can be patterned (e.g., using lithography or by selective deposition) to have gaps 15 between the portions of the metallic feature 14*a*, 14*b* along the direction of propagation (the x-axis). In FIG. 4B, only a few small discontinuities or gaps 15 are provided, which may not affect the electrical performance of the waveguide 10. In FIG. 4C, numerous gaps 15 are provided along the length of the waveguide 10, which may slightly affect the electrical performance. However, any degradation in electrical performance for the embodiment of FIG. 4C may be negligible or eliminated if the gaps 15 are significantly smaller than the wavelength of the waves W that are coupled to the waveguide 10. Thus, even though the metallic features 14*a*, 14*b* may have gaps 15 or discontinuities, the metallic channel 11 may nevertheless be effectively closed if the gaps 15 are sufficiently small as compared with the wavelength of the waves W.

For example, the gaps 15 can be sized so as to be less than 20% (e.g., less than 15%, or less than 10%) of the wavelength of the waves W to be coupled to the waveguide 10. In some embodiments, the gaps 15 can be sized so as to be in a range of 0.5% to 15%, in a range of 1% to 10%, or in a range of 2% to 5% of the wavelength of the waves W to be coupled to the waveguide 10. Relatively small pitches for the metallic features 14*a*, 14*b* and associated gaps 15 therein can be defined using lithographic techniques. In various embodiments, for example, the pitch of the gaps 15 and metallic features 14*a*, 14*b* can be 30 microns or less for wavelengths greater than 300 microns. In various embodiments, the pitch of the gaps 15 and metallic features 14*a*, 14*b* can be less than 20 microns or less than 10 microns. In various embodiments, the pitch of the gaps 15 and metallic features 14*a*, 14*b* can be in a range of 1 micron to 40 microns, in a range of 1 micron to 30 microns, in a range of 5 microns to 30 microns, in a range of 5 microns to 20 microns, or in a range of 5 microns to 10 microns. The ability to create small pitch discontinuities or gaps in the metallic features 14*a*, 14*b* in a semiconductor element (such as a die or interposer) can beneficially reduce dishing while enabling little or no degradation in electrical performance. For waveguides 10 that are completely embedded in the semiconductor element, the pitch can be further reduced, e.g., to below 1 micron as defined by photolithographic limits.

Figure 5:
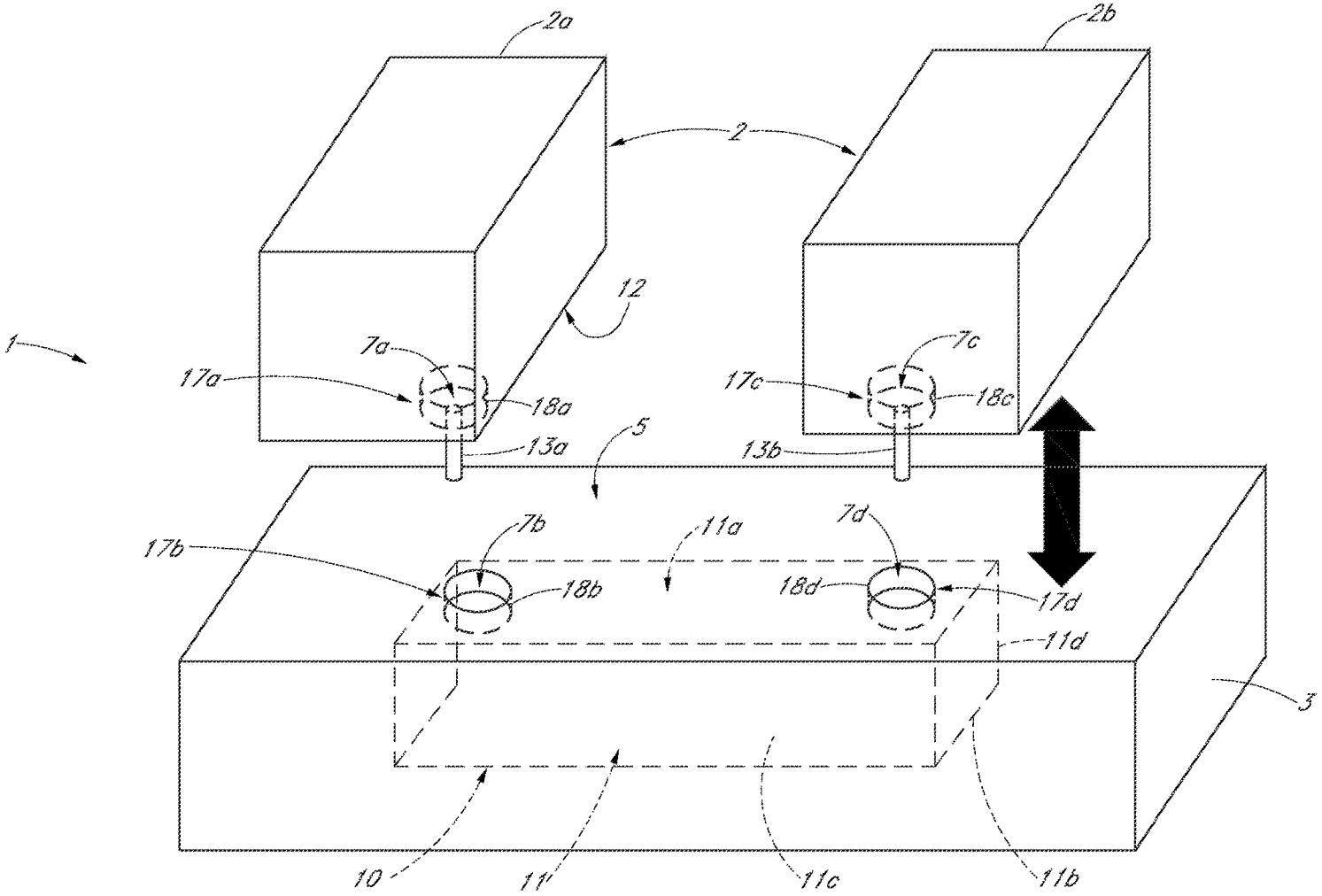
FIG. 5 is a schematic perspective view of a structure with a waveguide embedded in a carrier comprising a semiconductor element, prior to bonding of the dies to the carrier.

FIG. 5 is a schematic perspective view of a structure 1 with a waveguide 10 embedded in a carrier 3 comprising a semiconductor element, prior to bonding of the dies 2*a*, 2*b* to the carrier 3. In the embodiment of FIG. 5, the waveguide 10 is at least partially embedded in the carrier 3, which can comprise a semiconductor element such as an integrated device die, a semiconductor interposer, a reconstituted die or wafer, etc. In some embodiments, the waveguide 10 is completely embedded in the carrier 3 such that the walls 11*a*-11*d* of the channel 11 are buried within the carrier 3. In other embodiments, the waveguide 10 can be at least partially embedded in the carrier 3 but may have a wall 11*a* that is exposed at or near the upper surface 5 of the carrier 3. As with the embodiments of FIGS. 1, 2, 3A-3C, 4A-4C, the waveguide 10 can comprise a metallic channel 11 that defines an effectively closed metallic or conductive profile, as viewed from a side cross section taken along the direction of wave propagation. In some embodiments, the metallic channel 11 may comprise a continuous and completely closed profile, while in other embodiments, the metallic channel 11 may comprise gaps or discontinuities.

As shown in FIG. 5, the carrier 3 can comprise ports 17*b*, 17*d*, and the dies 2*a*-2*b* can comprise corresponding ports 17*a*, 17*c*. The ports 17*b*, 17*d* can extend through the effectively closed metallic channel 11 to the upper surface 5 of the carrier 3, and the ports 17*a*, 17*c* can be exposed on the lower surface 12 of the dies 2*a*-2*b*. The ports 17*a*-17*d* can be configured to couple to radiating elements 13*a*, 13*b* to transmit electromagnetic radiation to, or to receive electromagnetic radiation from, the waveguide 10. For example, the dies 2*a*, 2*b* can be aligned relative to the carrier 3 such that the port 17*a* generally aligns with the port 17*b* and the port 17*c* aligns with the port 17*d*, respectively. The dies 2*a*, 2*b* can be bonded to the carrier 3, including along the interface between the ports 17*a* and 17*b* and between the ports 17*c* and 17*d*. In the illustrated embodiment, for example, a metallic periphery 18*a* of the port 17*a* can be directly bonded to a metallic periphery 18*b* of the port 17*b* without an intervening adhesive. Similarly, a metallic periphery 18*c* of the port 17*c* can be directly bonded to a metallic periphery 18*d* of the port 17*d*. Dielectric features 7*a*-7*d* within the metallic peripheries 18*a*-18*d* can also be directly bonded to one another. In other embodiments, the metallic peripheries 18*a*-18*d* can be bonded in other ways, such as by way of a conductive adhesive or solder.

Upon bonding of the dies 2*a*, 2*b* to the carrier 3, the radiating elements 13*a*, 13*b* can electromagnetically couple to the waveguide 10 by way of the ports 17*b*, 17*d*. In the illustrated embodiment, the radiating elements 13*a*, 13*b* can comprise probes of a conductive segment that are inserted into openings in the metallic channel 11 defined by the ports 17*b*, 17*d*. In other embodiments, as explained above, the radiating elements 13*a*, 13*b* can comprise other suitable structures, such as conductive loops or apertures. Accordingly, in the embodiment shown in FIG. 5, the waveguide 10 can be at least partially embedded in the carrier 3 which can comprise a semiconductor element or other substrate material with a bonding layer (e.g., silicon oxide) having metallic features embedded therein. Bonding the dies 2*a*, 2*b* to the carrier can provide electrical communication between the dies 2*a*, 2*b* by electromagnetically coupling the dies 2*a*, 2*b* to the waveguide 10 within the carrier 3.

Figure 6:
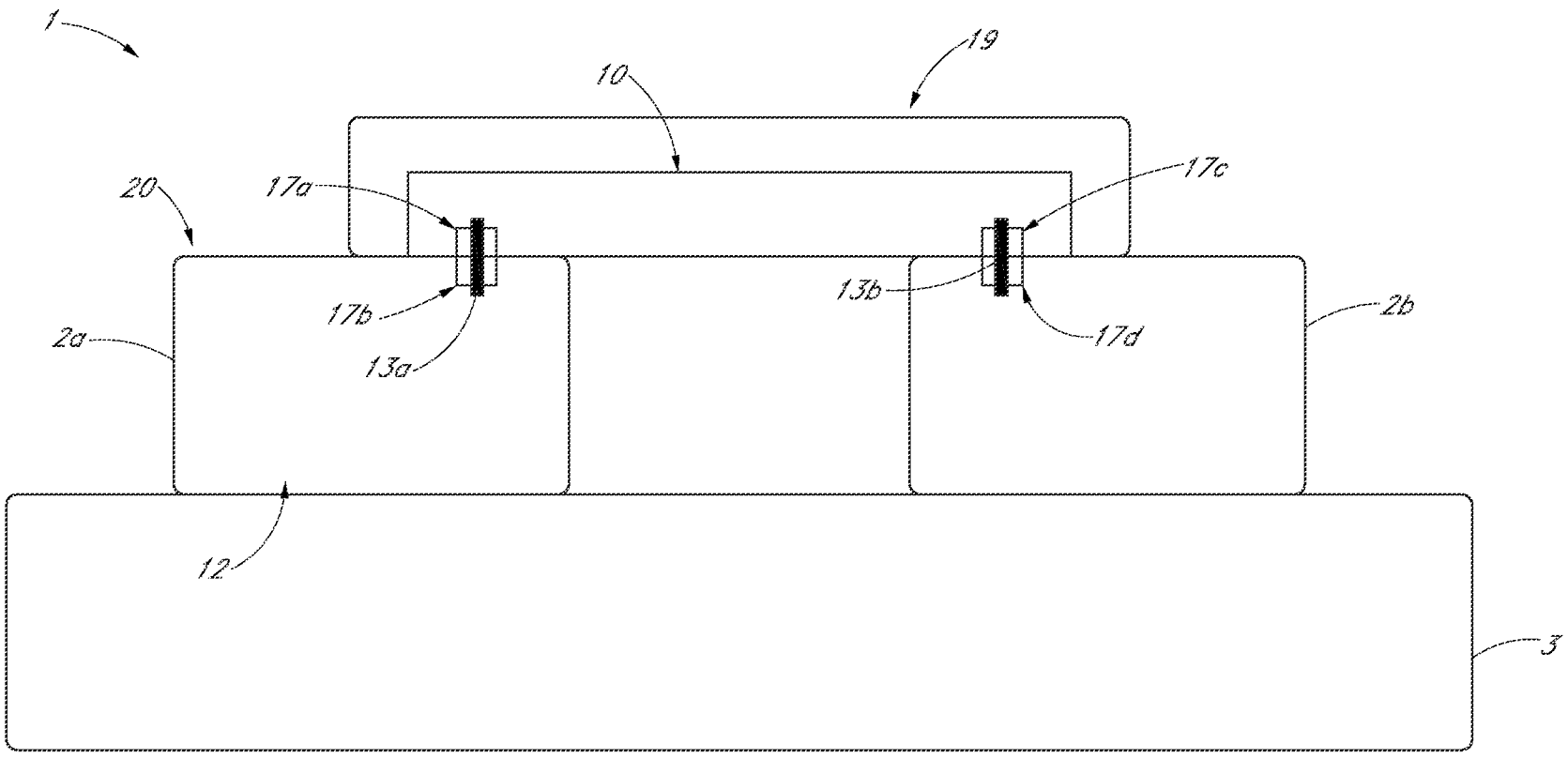
FIG. 6 is a schematic side view of a structure comprising a bridge between two dies that includes an integrated waveguide therein.

FIG. 6 is a schematic side view of a structure 1 comprising a bridge 19 between the dies 2*a*, 2*b* that includes an integrated waveguide 10 therein. Unless otherwise noted, the components of FIG. 6 may be the same as or generally similar to like numbered components of FIGS. 1-5. For example, in FIG. 6, the structure can comprise integrated device dies 2*a*, 2*b* bonded (e.g., directly bonded) to the carrier 3. However, unlike the embodiments of FIGS. 1-5, in FIG. 6, the bridge 19 can be bonded to the dies 2*a*, 2*b* on upper surfaces 20, which can be the active surfaces, of the dies 2*a*, 2*b*, which are opposite the lower surfaces 12 and the carrier 3. The waveguide 10 can be provided at least partially in the bridge 19 as shown in FIG. 6. In some embodiments, the waveguide 10 can be at least partially (e.g., completely) embedded in the bridge 19, similar to the manner in which the waveguide 10 is embedded in the carrier 3 as shown in FIG. 5. In other embodiments, the waveguide 10 can be defined by features along both sides of an interface between the dies 2*a*, 2*b* and the bridge 19, similar to the manner in which the waveguide 10 is defined in FIGS. 3A-3B. As with the above embodiments, the waveguide 10 can comprise a metallic channel having an effectively closed profile (e.g., completely closed or including small discontinuities or gaps) and within which a dielectric material is disposed, as viewed along a cross section taken transverse to the propagation direction. In some embodiments, the bridge 19 comprises a semiconductor element, such as an interposer, an integrated device die, etc. In some embodiments, the bridge 19 may be the waveguide itself, such that the waveguide 10 spans the gap between the dies 2*a*, 2*b*. In other embodiments, the waveguide can be provided directly across the dies, instead of embedding it in a bridge structure.

Figure 7A:
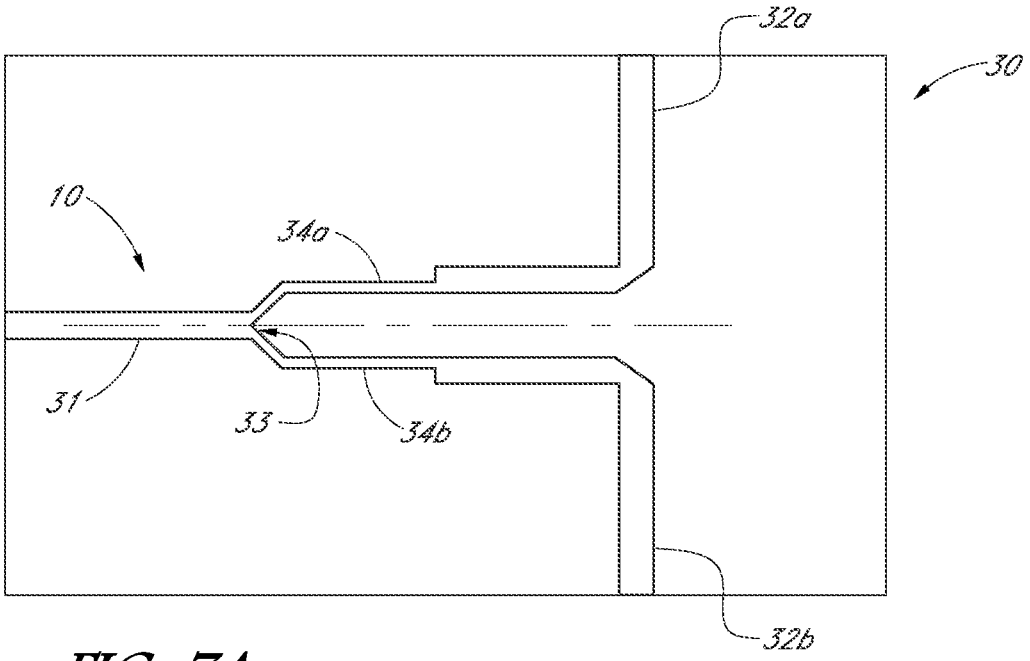
FIG. 7A is a top plan view of a power divider that incorporates any of the waveguides described herein.

FIGS. 7A-7D illustrate various devices that can be constructed utilizing the waveguides 10 disclosed herein. As explained above, the waveguides 10 utilized in FIGS. 7A-7D can comprise effectively closed metallic channels (e.g., completely closed or with discontinuities or gaps that are small compared to the electromagnetic wavelengths to be communicated therethrough). The waveguides 10 utilized in FIGS. 7A-7D can be defined along an interface between two elements (such as between a die and a carrier, as in FIGS. 3A-3C), or can be at least partially embedded in one element (similar to the embodiment of FIG. 5). FIG. 7A is a top plan view of a power divider 30 that incorporates any of the waveguide structures 10 described above. The power divider 30 can comprise waveguide structures 10 disposed in or on an element (such as a substrate, interposer, integrated device die, etc.). The waveguide 10 can comprise a primary channel 31 that splits into a plurality of divided channels 32*a*, 32*b* at a junction 33. Divided channels 32*a*, 32*b*, 34*a*, and 34*b* can also be defined as waveguide structures similar to the waveguides 10 disclosed herein. The power divider based on the integrated waveguide structures disclosed herein may function in a manner similar to conventional planar power dividers based on microstrips or striplines. However, beneficially, the embodiments disclosed herein can provide lower losses and better performance at higher frequencies. The waveguide 10 may broaden out at the divided channels 32*a*, 32*b*. The power divider 30 can divide or split the power of the electromagnetic waves that propagate along the waveguide 10.

Figure 7B:
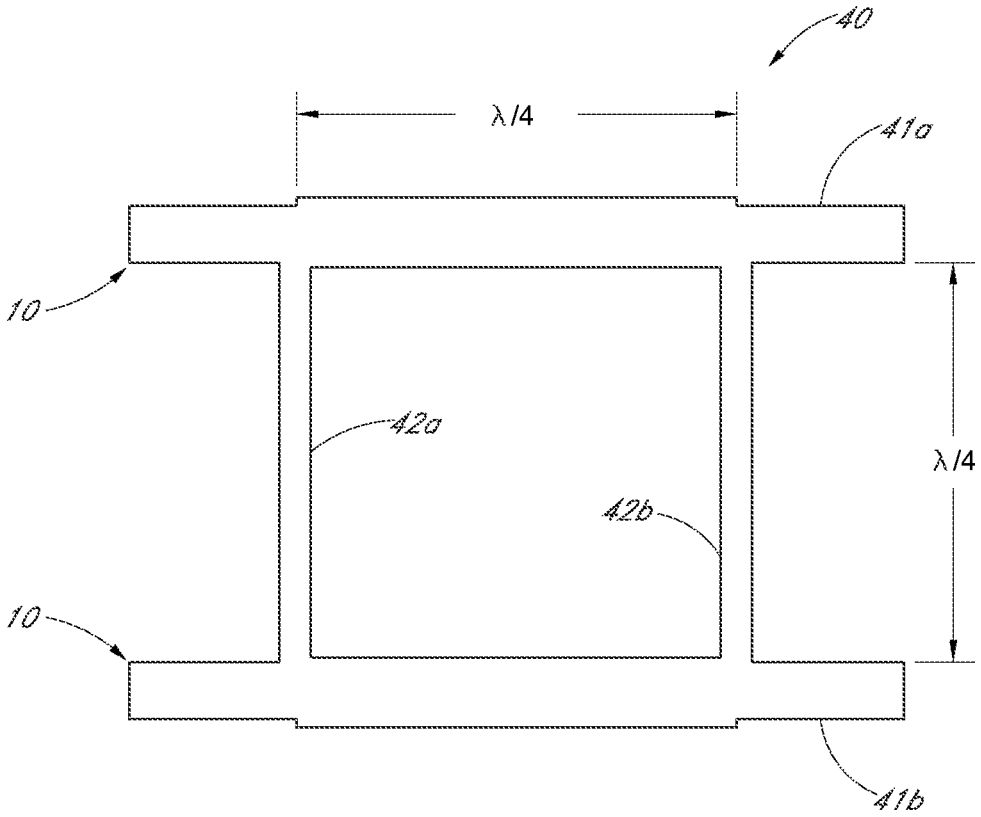
FIG. 7B is a top plan view of a coupler that incorporates the waveguides described herein.

FIG. 7B is a top plan view of a coupler 40 that incorporates the waveguides 10 described herein. The coupler 40 can comprise one or more waveguides 10 disposed in or on an element (such as a substrate, interposer, integrated device die, etc.). The waveguide 10 can comprise first and second longitudinal arms 41*a*, 41*b* that are spaced apart from one another, e.g., by a quarter wavelength or $\lambda/4$. As shown in FIG. 7B, the arms 41*a*, 41*b* can be connected by connector waveguides 42*a*, 42*b*. The connector waveguides 42*a*, 42*b* can be spaced apart from one another, e.g., by a quarter wavelength or $\lambda/4$. During operation, electromagnetic waves can propagate along the longitudinal arms 41*a*, 41*b* of the waveguide 10. The waves propagating along one of the arms 41*a*, 41*b* can couple to the waves propagating along the other of the arms 41*a*, 41*b*, by propagating along the connector waveguides 42*a*, 42*b*. The coupler based on the integrated waveguide structures may function in a manner similar to a conventional planar coupler based on microstrips or striplines. However, beneficially, the embodiments disclosed herein may provide lower losses and better performance at higher frequencies.

Figure 7D:
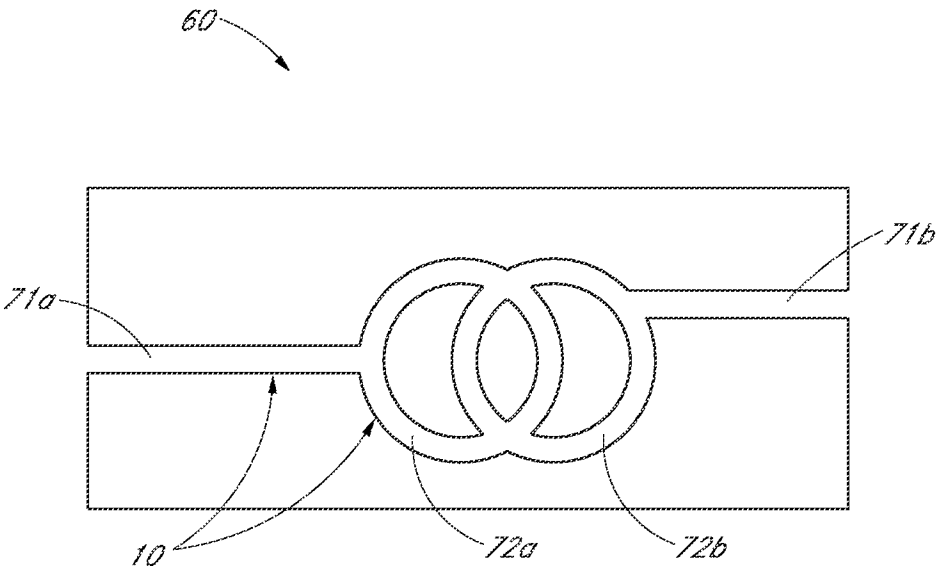
FIG. 7D is a top plan view of a filter that incorporates the waveguides disclosed herein.
Figure 7C:
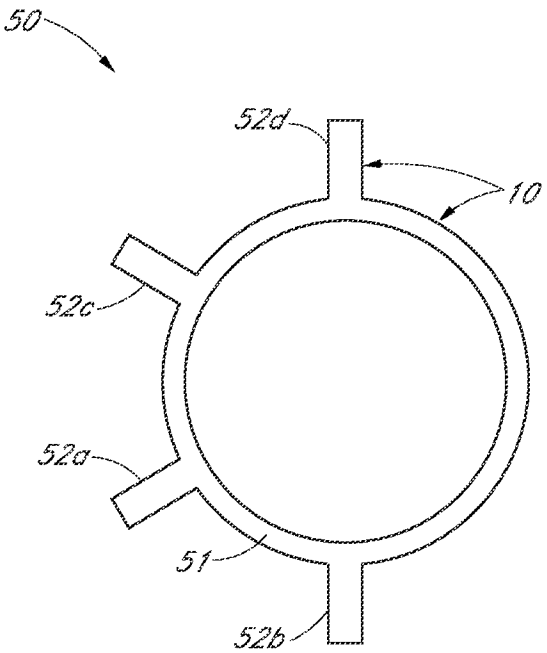
FIG. 7C is a top plan view of a circulator that incorporates the waveguides described herein.

FIG. 7C is a top plan view of a circulator 50 that incorporates the waveguides 10 described herein. The circulator 50 can comprise one or more waveguides 10 disposed in or on an element (such as a substrate, interposer, integrated device die, etc.). The circulator 50 can include a waveguide 10 having a curved or circular pathway 51. A first port 52*a* can act as an input for coupling electromagnetic radiation into the circular pathway 51. Second and third ports 52*b*, 52*c* can act as in-phase output ports for directing electromagnetic radiation out of the circular pathway 51. A fourth port 52*d* can comprise an isolated port. The circulator based on the integrated waveguide structures disclosed herein may function in a manner similar to a conventional planar circulator based on microstrips or striplines. However, beneficially, the embodiments disclosed herein may provide lower losses and better performance at higher frequencies.

FIG. 7D is a top plan view of a filter 60 that incorporates the waveguides 10 disclosed herein. The filter 60 can comprise one or more waveguides 10 disposed in or on an element (such as a substrate, interposer, integrated device die, etc.). The waveguide 10 can comprise an input line 71*a* and an output line 71*b*. A plurality of ring-shaped elements 72*a*, 72*b* can be provide between the input and output lines 71*a*, 71*b*. For example, the input line 71*a* can electromagnetically couple with the ring-shaped element 72*a*. The ring-shaped element 72*a* can couple with the ring-shaped element 72*b*, which can in turn electromagnetically couple with the output line 71*b*. Selected wavelength(s) of radiation propagating along the input line 71*a* can be filtered by the ring-shaped elements 72*a*, 72*b*, such that only the selected wavelength(s) are transmitted to the output line 71*b*. The filter based on the integrated waveguide structures disclosed herein may function in a manner similar to a conventional planar filter based on microstrips or striplines. However, beneficially, the embodiments disclosed herein may provide lower losses and better performance at higher frequencies.

Thus, as shown in FIGS. 7A-7D, the waveguides 10 disclosed herein in FIGS. 1, 2, 3A-3C, 3A-3C, 5 and 6 can be shaped in plan view in any suitable manner so as to define various components that have different electrical functionalities. The waveguides 10 may accordingly be bent, angled, or curved, as seen from a top view. Moreover, the waveguides 10 can comprise multiple components that interact with one another to define various types of devices.

Figure 8:
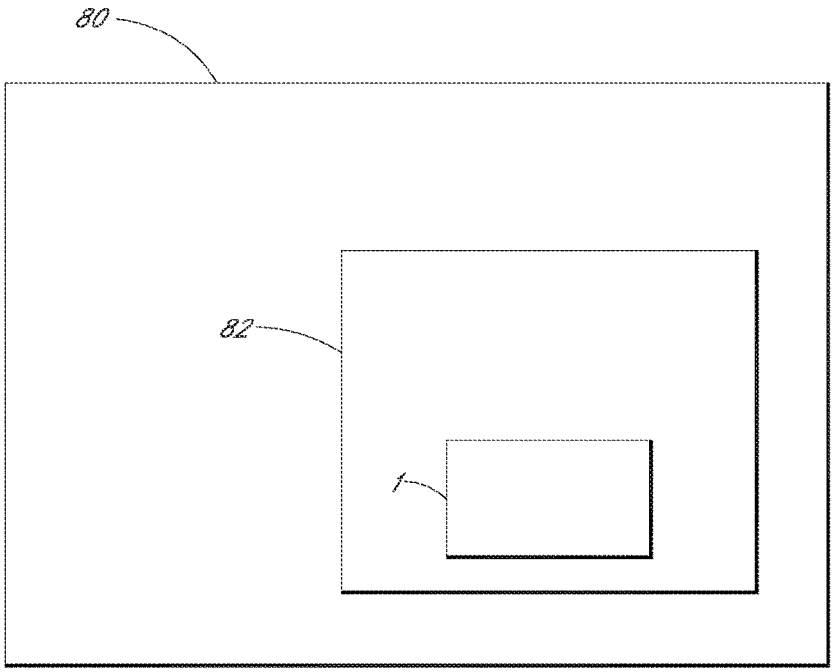
FIG. 8 is a schematic system diagram of an electronic system incorporating one or more structures, according to various embodiments.

FIG. 8 is a schematic system diagram of an electronic system 80 incorporating one or more structures 1, according to various embodiments. The system 80 can comprise any suitable type of electronic device, such as a mobile electronic device (e.g., a smartphone, a tablet computing device, a laptop computer, etc.), a desktop computer, an automobile or components thereof, a stereo system, a medical device, a camera, or any other suitable type of system. In some embodiments, the electronic system 80 can comprise a microprocessor, a graphics processor, an electronic recording device, or digital memory. The system 80 can include one or more device packages 82 which are mechanically and electrically connected to the system 80, e.g., by way of one or more motherboards. Each package 82 can comprise one or more structures 1. The system 80 shown in FIG. 8 can comprise any of the structures 1 shown and described herein.

In one embodiment, a structure is disclosed. The structure can include a first element and a carrier bonded to the first element along an interface. The structure can include a waveguide defined at least in part along the interface between the first element and the carrier. The waveguide can comprise an effectively closed metallic channel and a dielectric material within the effectively closed metallic channel as viewed from a side cross-section of the structure.

In another embodiment, a structure is disclosed. The structure can include a semiconductor element having a waveguide at least partially embedded therein. The waveguide can comprise an effectively closed metallic channel and a dielectric material within the effectively closed metallic channel as viewed from a side cross-section of the structure. The structure can include a first port extending through the effectively closed metallic channel to an exterior surface of the semiconductor element. The first port can be configured to couple to a radiating element to transmit electromagnetic radiation to, or to receive electromagnetic radiation from, the waveguide.

In another embodiment, a method of forming a structure is disclosed. The method can include providing a first element and a carrier. The first element can comprise first metallic features and first dielectric features exposed on an exterior surface of the first element. The carrier can comprise second metallic features and second dielectric features exposed on an exterior surface of the carrier. The method can include bonding the first element to the carrier along an interface to bond the first metallic features and the second metallic features and to bond the first dielectric features and the second dielectric features. The bonded first element and carrier can define a waveguide at least in part along the interface between the first element and the carrier. The waveguide can comprise an effectively closed metallic channel and a dielectric material within the effectively closed metallic channel as viewed from a side cross-section of the structure.

For purposes of summarizing the disclosed embodiments and the advantages achieved over the prior art, certain objects and advantages have been described herein. Of course, it is to be understood that not necessarily all such objects or advantages may be achieved in accordance with any particular embodiment. Thus, for example, those skilled in the art will recognize that the disclosed implementations may be embodied or carried out in a manner that achieves or optimizes one advantage or group of advantages as taught or suggested herein without necessarily achieving other objects or advantages as may be taught or suggested herein.

All of these embodiments are intended to be within the scope of this disclosure. These and other embodiments will become readily apparent to those skilled in the art from the following detailed description of the embodiments having reference to the attached figures, the claims not being limited to any particular embodiment(s) disclosed. Although this certain embodiments and examples have been disclosed herein, it will be understood by those skilled in the art that the disclosed implementations extend beyond the specifically disclosed embodiments to other alternative embodiments and/or uses and obvious modifications and equivalents thereof. In addition, while several variations have been shown and described in detail, other modifications will be readily apparent to those of skill in the art based upon this disclosure. It is also contemplated that various combinations or sub-combinations of the specific features and aspects of the embodiments may be made and still fall within the scope. It should be understood that various features and aspects of the disclosed embodiments can be combined with, or substituted for, one another in order to form varying modes of the disclosed implementations. Thus, it is intended that the scope of the subject matter herein disclosed should not be limited by the particular disclosed embodiments described above, but should be determined only by a fair reading of the claims that follow.

What is claimed is:

1. A structure comprising:

a first element;

a carrier bonded to the first element along an interface; and a waveguide defined at least in part along the interface between the first element and the carrier, the waveguide comprising an effectively closed metallic channel and a dielectric material within the effectively closed metallic channel as viewed from a side cross-section of the structure, wherein first metallic features are defined in the first element and second metallic features are defined in the carrier, the first and second metallic features being bonded to one another to define the effectively closed metallic channel, and wherein first dielectric features are defined in the first element and second dielectric features are defined in the carrier, the first and second dielectric features cooperate to define the dielectric material.

2. The structure of claim 1, wherein the carrier comprises a semiconductor material and the first element comprises an integrated device die.

3. The structure of claim 1, wherein the first element and the carrier are directly bonded to one another without an intervening adhesive.

4. The structure of claim 1, wherein the waveguide is at least partially embedded in the carrier with a wall of the metallic channel exposed at an upper surface of the carrier.

5. The structure of claim 1, wherein the effectively closed metallic channel comprises gaps between portions of the metallic channel, the gaps being smaller than a wavelength of electromagnetic radiation to be propagated along the waveguide.

6. The structure of claim 5, wherein the gaps are less than 10% of the wavelength of the electromagnetic radiation.

7. The structure of claim 6, further comprising a second element bonded to the carrier along a second interface and spaced laterally from the first element, the waveguide extending from the first element to the second element and being defined at least in part along the second interface between the carrier and the second element.

8. The structure of claim 7, wherein the waveguide comprises a first waveguide portion defined by a lower surface of the first element and an upper surface of the carrier and a second waveguide portion underlying a gap between the first and second elements, wherein a height of the second waveguide portion is less than a height of the first waveguide portion.

9. The structure of claim 8, further comprising a first port extending from the first element through the metallic channel, the first port configured to couple to a first radiating element to transmit electromagnetic radiation to, or to receive electromagnetic radiation from, the waveguide.

10. The structure of claim 7, further comprising a third element bonded to the carrier and a second wave guide defined at least in part along a third interface, the third element spaced laterally from the first element and the second element, the second waveguide extending from the second element to the third element and being defined at least in part along the third interface between the carrier and the second element.

11. The structure of claim 1, wherein the carrier comprises a bridge extending between an upper surface of the first element and an upper surface of a second element spaced apart from the first element, the waveguide at least partially embedded in the bridge, wherein the structure further comprises a second carrier, wherein lower surfaces of the first and second elements are bonded to the second carrier.

12. The structure of claim 1, wherein the waveguide is shaped so as to define a device comprising at least one of a power divider, a coupler, a circulator, and a filter.

13. A structure comprising:

a semiconductor element having a waveguide at least partially embedded therein, the waveguide comprising an effectively closed metallic channel and a dielectric material within the effectively closed metallic channel as viewed from a side cross-section of the structure;

a first port extending through the effectively closed metallic channel to an exterior surface of the semiconductor element, the first port configured to couple to a radiating element to transmit electromagnetic radiation to, or to receive electromagnetic radiation from, the waveguide, wherein the first port comprises a first metallic boundary and a dielectric feature disposed within the first metallic boundary; and a first element bonded to the semiconductor element, the first element having a second port having a second metallic boundary, the first and second metallic boundaries aligned with and bonded to one another.

14. The structure of claim 13, wherein the waveguide is completely embedded in the semiconductor element.

15. The structure of claim 13, further comprising a third port having a third metallic boundary and extending through the effectively closed metallic channel to the exterior surface of the semiconductor element, and a second element bonded to the semiconductor element and laterally spaced from the first element, the second element comprising a fourth port having a fourth metallic boundary, the third and fourth metallic boundaries aligned with and bonded to one another.

16. The structure of claim 13, wherein the effectively closed metallic channel comprises a completely closed metallic channel.

17. The structure of claim 13, wherein the effectively closed metallic channel comprises gaps between portions of the metallic channel, the gaps being smaller than a wavelength of electromagnetic radiation to be propagated along the waveguide.

18. A method of forming a structure, the method comprising:

providing a first element and a carrier, wherein the first element comprises first metallic features and first dielectric features exposed on an exterior surface of the first element and the carrier comprises second metallic features and second dielectric features exposed on an exterior surface of the carrier;

bonding the first element to the carrier along an interface to bond the first metallic features and the second metallic features and to bond the first dielectric features and the second dielectric features, the bonded first element and carrier defining a waveguide at least in part along the interface between the first element and the carrier, the waveguide comprising an effectively closed metallic channel and a dielectric material within the effectively closed metallic channel as viewed from a side cross-section of the structure.

19. The method of claim 18, wherein bonding the first element to the carrier comprises directly bonding the first element to the carrier without an intervening adhesive.

20. A structure comprising:

a first element;

a carrier directly bonded to the first element along an interface without an intervening adhesive; and a waveguide defined at least in part along the interface between the first element and the carrier, the waveguide comprising an effectively closed metallic channel and a dielectric material within the effectively closed metallic channel as viewed from a side cross-section of the structure, wherein first metallic features are defined in the first element and second metallic features are defined in the carrier, the first and second metallic features being bonded to one another to define the effectively closed metallic channel, and wherein first dielectric features are defined in the first element and second dielectric features are defined in the carrier, the first and second dielectric features being bonded to one another to define the dielectric material.

21. The structure of claim 20, wherein the first and second metallic features are directly bonded without an intervening adhesive.

22. The structure of claim 20, wherein the first and second dielectric features are directly bonded without an intervening adhesive.

23. The structure of claim 20, wherein the effectively closed metallic channel comprises gaps between portions of the metallic channel, the gaps being smaller than a wavelength of electromagnetic radiation to be propagated along the waveguide.

* * * * *